United States Patent [19]

Doorley

[11] Patent Number: 4,864,902

[45] Date of Patent: Sep. 12, 1989

[54] SOCKET WRENCH SLUGGING DEVICE

[76] Inventor: Richard B. Doorley, 124 Van Wyck Ave., Pittsburgh, Pa. 15227

[21] Appl. No.: 241,466

[22] Filed: Sep. 8, 1988

[51] Int. Cl.[4] ..... B25B 19/00

[52] U.S. Cl. ..... 81/466; 173/93

[58] Field of Search ..... 81/121.1, 124.6, 177.2, 81/177.5, 466, 461; 173/93

[56] References Cited

U.S. PATENT DOCUMENTS

| | | | |
|---|---|---|---|
| 2,313,398 | 3/1943 | Ronning | 173/93 |
| 2,744,431 | 5/1956 | Scime | 81/124.7 |
| 3,079,819 | 3/1963 | Wing | 81/124.6 |
| 3,799,011 | 3/1974 | Davis | 81/466 X |
| 4,084,454 | 4/1978 | Day | 81/124.7 |
| 4,628,776 | 12/1986 | Witbeck | 81/466 |

*Primary Examiner*—James G. Smith

*Attorney, Agent, or Firm*—William J. Ruano

[57] ABSTRACT

A striking tool device formed of a cylindrical metal shaft having, at one end, a square bore for mating with the drive tang of a ratchet wrench and, at the other end, a square shank for mating with a socket, and an arm member attached to said cylindrical metal shaft extending substantially at right angles thereto. The arm member has an anvil-like end portion of slightly larger diameter. The end portion has two flat striking surfaces on opposite sides for allowing striking by a hammer. Such striking creates a sufficient shock impulse to loosen a "frozen" nut or bolt.

5 Claims, 2 Drawing Sheets

SOCKET WRENCH SLUGGING DEVICE

This invention relates to a slugging wrench for the loosening of "frozen" bolts and nuts when used with a common socket wrench set.

BACKGROUND OF THE INVENTION

Slugging wrenches are presently used in the loosening of bolts and nuts that are "frozen" such as by rust, over tightening, corrosion, etc.. These slugging wrenches, while effective in some situations, have several outstanding disadvantages such as they must be held in place with one hand while being struck, therefore placing the user's hand in danger of being struck also. Another disadvantage of current slugging wrenches is that the wrenches are designed to fit a specific sized nut or bolt, necessitating a user to have an entire set of these slugging wrenches to meet the various situations he might encounter. Furthermore, present slugging wrenches are limited in their application due to the large unobstructed space needed around a "frozen" nut or bolt to enable the slugging wrench to be struck by a hammer. Offset slugging wrenches designed to overcome this problem are not acceptable because of their tendency to slip off or the nut or bolt when struck by the hammer. The transfer of the impact force is not satisfactory in this offset design.

SUMMARY OF THE INVENTION

An object of the present invention is to overcome the above stated disadvantages by providing a striking tool which can be used in conjunction with a common socket wrench set, thus providing a single tool which can be used to loosen a wide range of sizes of nuts and bolts. In addition, the present invention will provide a striking tool which can be used in tight spaces where it would be impossible to use a common slugging wrench.

BRIEF DESCRIPTION OF THE DRAWINGS

FIG. 7 is a top view of the slideable arm portion 13 showing the bored end which mates with the splined shaft 10a;

DESCRIPTION OF THE PREFERRED EMBODIMENTS

For the loosening of "frozen" nuts and bolts it is often necessary to apply an impact force by striking a wrench which is affixed to the problem nut or bolt. The resultant shock pulse often loosens the problem part. The invention described herein provides a striking device which can be easily used with a common socket wrench set for loosening such "frozen" parts.

Figure 1:
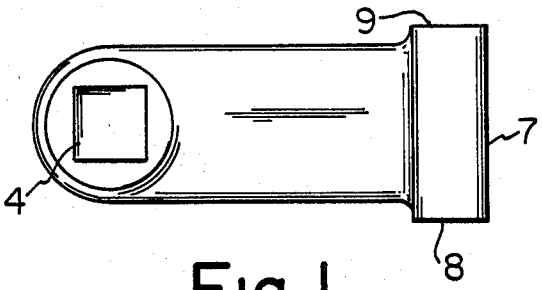
FIG. 1 shows a top view of a striking tool device embodying the present invention.
Figure 2:
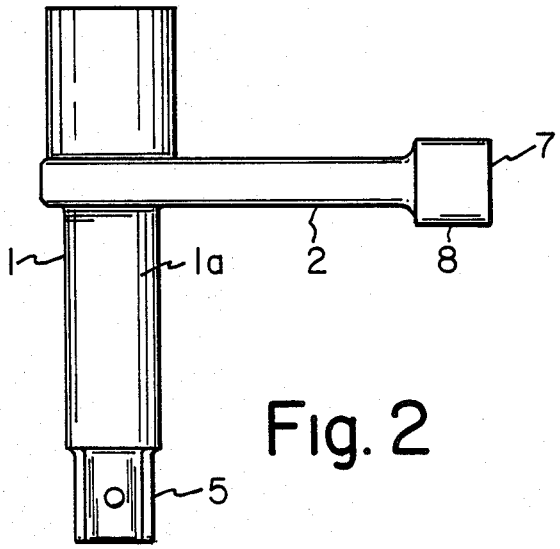
FIG. 2 is an elevational view of the striking tool device.
Figure 3:
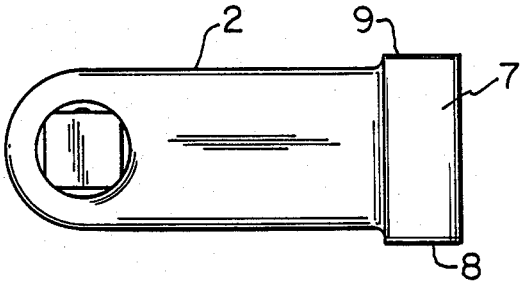
FIG. 3 is a bottom view of the striking tool device.

Referring to FIGS. 1–3, numeral 1 refers generally to a striking tool device comprising a cylindrical metal shaft 1*a* such as is commonly used as an extension shaft in a socket wrench set. The upper end of said shaft 1*a* having a square bore 4 for mating with the drive tang of a ratchet wrench, while the lower end terminates in a square shank 5 for mating with a socket. Rigidly attached, and made of a like metal, is an arm member 2 that extends at a substantially right angle from shaft 1*a*. Said arm member 2 has an anvil-like end portion 7 that is slightly larger than the body of said arm member 2. Two flat striking surfaces 8 and 9 are positioned on opposing sides of said anvil-like end portion 7. Said striking surfaces 8 and 9 are for being struck by a hammer either in a clockwise or counter clockwise direction so as to create the necessary shock impulse to loosen a "frozen" nut or bolt. Obviously, since said striking surfaces 8 and 9 can be struck in either direction, a bolt could also be tightened if so desired.

Figure 4:
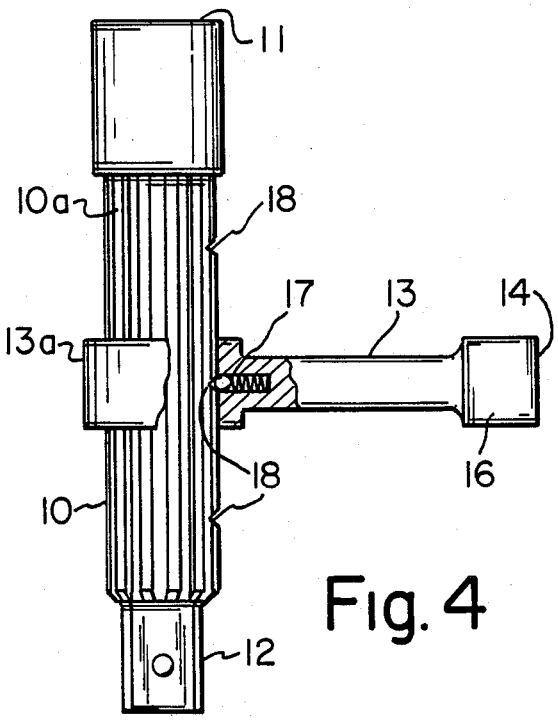
FIG. 4 is an elevational view partly in cross-section.
Figure 5:
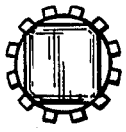
FIG. 5 is an end view of the shaft 10 without the slidable arm being engaged.
Figure 6:
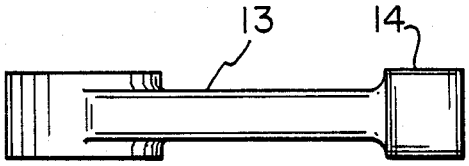
FIG. 6 is an elevational view of the slidable arm portion 13 of the present invention.
Figure 7:
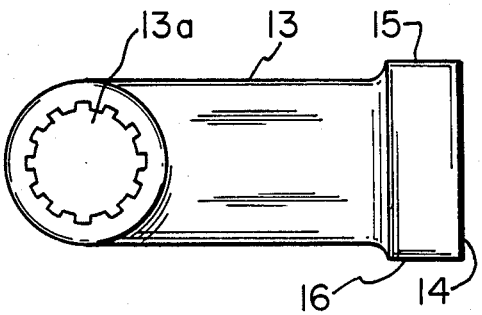
Figure 8:
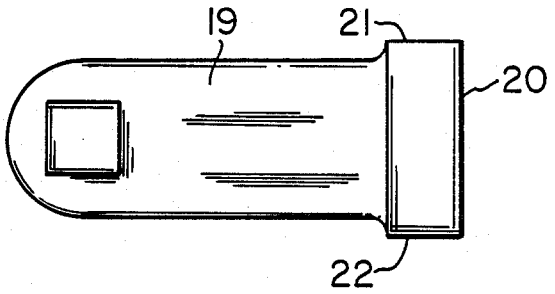
FIG. 8 is a top view of a further modification of the striking tool device embodying the present invention.

Referring more particularly to FIGS. 4–6, numeral 10 denotes an embodiment of the present invention comprising a metal shaft 10*a* having a central portion of splined cross-section and having at its top end a square bore 11 for mating with the drive tang of a ratchet wrench, while the lower end terminates in a square shank 12 for mating with sockets. Adjustably attached to said shaft 10*a* is arm 13 which has a bored end 13a (see FIG. 7) which mates with the central splined portion of said shaft 10*a*. In addition, said arm 13 has an optional ball spring detent locking means 17 for selectively locking said arm 13 at the desired vertical position along the splined portion of said shaft 10*a* which has a multiplicity of notches 18 for receiving the ball portion of said locking means. The opposite end of said arm 13 is a slightly enlarged anvil-like end portion 14 having two flat surfaces 15 and 16 for being struck by a hammer so as to create the necessary shock impulse to loosen a "frozen" nut or bolt.

Referring more particularly to FIGS. 8–11, numeral 26 generally denotes a striking tool embodiment for use when a longer extension shaft is not desired. Numeral 23 refers to a short hexagonal body having a squared upper portion 24 for accepting open-ended wrenches or adjustable wrenches, and, a squared shank 25 at its opposite end for mating with sockets. Rigidly attached and extending at a substantially right angle from said hexagonal body 23 is an arm 19 which has a slightly enlarged anvil-like end portion 20 having two flat surfaces 21 and 22 for being struck by a hammer so as to create the necessary shock impulse to loosen a "frozen" nut or bolt.

In operation, an appropriate wrench is selected and fitted over said hexagonal body 23 or said squared upper portion 24. An appropriate socket is fitted on said square shank 25 which is engaged to the nut or bolt to be acted upon, either loosened or tightened. While applying pressure to the wrench, said striking face 21 or 22 is struck by a hammer in the desired direction to create the desired shock impulse.

One advantage of this embodiment is that of having a full 360 degree access for hitting the striking tool because of its position above the wrench. Another advantage of this embodiment as well as the first two striking tools described is that the impacting forces are not applied to the vulnerable indexing mechanisms of the ratchet wrench.

Figure 12:
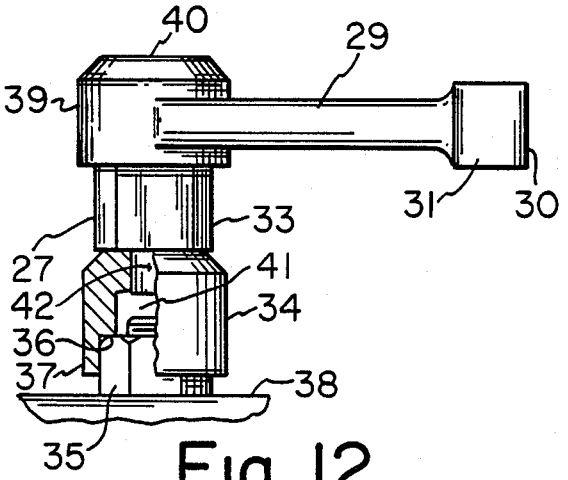
FIG. 12 is a plan view of a further embodiment of this invention, for impacting axially as well as rotationally.
Figure 9:
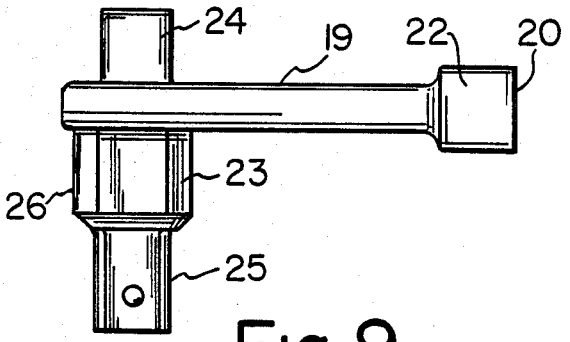
FIG. 9 is a plan view of the modified striking tool device.
Figure 13:
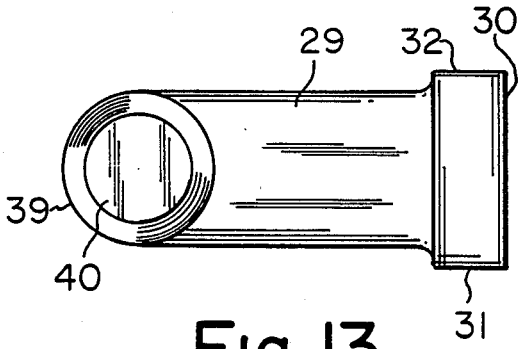
FIG. 13 is a top view of the embodiment shown in FIG. 12.
Figure 10:
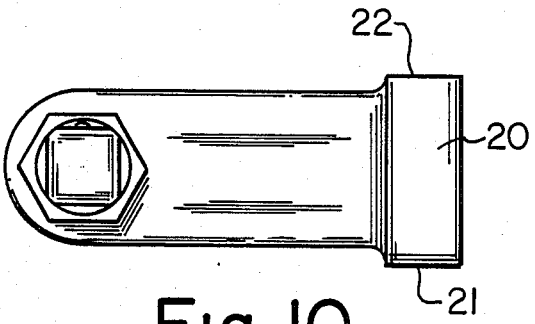
FIG. 10 is a bottom view of the modified striking tool device.
Figure 11:
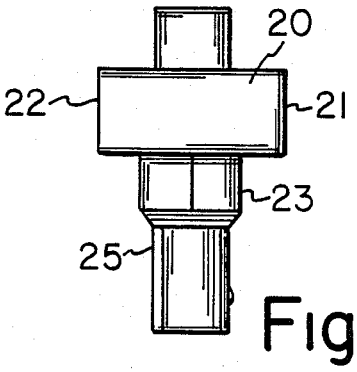
FIG. 11 is an end view of the modified striking tool device.

Referring to FIG. 12, in partial section, and 13 as another embodiment of this invention, numeral 27 generally denotes a striking tool embodiment for use for impacting either rotationally, as described earlier, or axially. Axial impacting-hammering on a bolt or nut in the direction of its main axis, tends to loosen the fit between the male thread of the bolt and the female thread of the nut. With a wrenching force being applied at the time of impact, the frozen item is free to move incrementally. Numeral 33 refers to a hexagonal body for accepting adjustable and non-adjustable wrenches. Radially-attached lever arm 29 hand an anvil-like end portion 30 having two flat surfaces 31 and 32 for being struck by a hammer so as to create the necessary shock impulse to loosen a frozen nut or bolt by direct rotational force as described in other embodiments of this invention.

Numeral 34 is a modification of a conventional socket such as to transfer downward, axial, shock pulsed the nut or bolt head item 35. This modification includes a sholder 36 which makes contact with the top surface of the frozen nut/bolt 35, with skirt 37 being sufficiently short to not make contact with the bolted member 38. Boss 39, located on the rotational axis of arm 29, contains striking surface 40 for being struck by a hammer (as turning force is being applied by the wrench), which impact transfers to the nut/bolt 35 through contact with the shoulder 36, for jarring loose the fit between the male and female threads of the fastener components. Relief volume 41 is provided for clearing bolt ends which extend beyond the top surface of the nut.

This embodiment shows socket 34 as being removable from square shank 42 for permitting changing sockets and for installing box-end wrenches to hexagonal body 33. An optional design is for socket 34 and shaft 33 to be as a permanent assembly, with arm 29 loosely attached via a spline, such as shown in FIGS. 4, 5 and 6, or by an extension of hexagonal body 33.

While the above has illustrated several embodiments of the invention, it will be understood that these are by way of illustration only and that various changes and modifications may be contemplated in my invention and within the scope of the following claims:

I claim:

1. A striking tool device comprising a many sided metal shaft, for receiving a box-end wrench or adjustable wrench, said shaft having, at one end, a square shank for mating with a socket, and an arm member radially attached thereto at the opposite end, said arm having an anvil-like end portion slightly larger than said arm, said end portion having two flat striking surfaces on opposite sides for allowing striking of said flat striking surfaces by a hammer either in a clockwise or counter-clockwise direction necessary to create sufficient shock impulse to loosen a "frozen" nut or bolt, said manysided shaft extending beyond the radial arm and having a different number of sides for allowing a multiplicity of wrench types to act as torquing arms.

2. A striking tool device comprising a hexagonal metal shaft having, at on end, a square shank for mating with a shock, an arm member radially and rigidly attached thereto, said arm member having an anvil-like end portion slightly larger than said arm member, said end portion having two flat striking surfaces on opposite sides thereof for allowing striking of said flat striking surfaces by a hammer either in a clockwise or counter-clockwise direction necessary to create sufficient rotational shock impulse to loosen a "frozen" nut or bolt, and a boss centrally mounted on a turn-axis of the arm member, said boss having a flat striking surface for axial impacting with a hammer for loosening the mating threads of the bolt or nut.

3. A striking tool device as recited in claim 2 wherein said socket has a shoulder for contacting a top surface of the nut or bolt for transferring axial impact energy into the bolt or nut for loosening said nut or bolt.

4. A striking tool device as recited in claim 3 wherein said socket contains a relief area for clearing bolt ends which extend beyond the top surface of the nut.

5. A striking tool device comprising a many sided metal shaft, for receiving a box-end wrench or adjustable wrench, said shaft having, at one end, a polygonal shank for mating with a socket, and an arm member radially attached thereto at the opposite end, said arm having an anvil-like end portion slightly larger than said arm, said end portion having two flat striking surfaces on opposite sides for allowing striking of said flat striking surfaces by a hammer either in a clockwise or counter-clockwise direction necessary to create sufficient shock impulse to loosen a "frozen" nut or bolt, said many sided shaft extending beyond the radial arm and having a number of sides for allowing a multiplicity of wrench types to act as torquing arms.

* * * * *